United States Patent [19]

Vural

[11] Patent Number: 5,046,891

[45] Date of Patent: Sep. 10, 1991

[54] VIBRATOR ROLLER FOR SOIL COMPACTION

[75] Inventor: Gülertan Vural, Emmelshausen, Fed. Rep. of Germany

[73] Assignee: BOMAG GmbH, Boppard, Fed. Rep. of Germany

[21] Appl. No.: 485,903

[22] Filed: Feb. 27, 1990

[30] Foreign Application Priority Data

Mar. 1, 1989 [DE] Fed. Rep. of Germany ..... 3906392

[51] Int. Cl.[5] ..... E01C 19/28; E01C 19/38

[52] U.S. Cl. ..... 404/117; 37/DIG. 18; 404/113; 405/271

[58] Field of Search ..... 405/271, 258, 270, 268, 405/303; 404/117, 113; 37/DIG. 18

[56] References Cited

U.S. PATENT DOCUMENTS

| | | | |
|---|---|---|---|
| 3,543,656 | 12/1970 | Roettgey | 404/117 |
| 3,595,145 | 7/1971 | Mozdzanowski | 404/117 |
| 3,814,532 | 6/1974 | Barrett et al. | 404/117 |
| 3,846,037 | 11/1974 | Mozdzanowski | 404/117 |
| 4,313,691 | 2/1982 | Yargici | 404/117 |

FOREIGN PATENT DOCUMENTS

| | | | |
|---|---|---|---|
| 740192 | 8/1966 | Canada | 404/117 |
| 1484573 | 12/1969 | Fed. Rep. of Germany . | |
| 1930662 | 2/1971 | Fed. Rep. of Germany . | |
| 2150749 | 4/1973 | Fed. Rep. of Germany . | |
| 227994 | 10/1985 | German Democratic Rep. . | |

*Primary Examiner*—Dennis L. Taylor

*Attorney, Agent, or Firm*—Edwin E. Greigg; Ronald E. Greigg

[57] ABSTRACT

The invention relates to a vibrator roller for soil compaction, comprising an undercarriage having at least two roller drums disposed one after the other in the travel direction. Front and rear imbalance generators in the form of weights rotating with 180° phase displacement are assigned to the roller drums, and the undercarriage carries the superstructure, via elastic resilient pads. These resilient pads are positioned at least in the vicinity of the minimum vibration of the undercarriage, so that practically total vibrational decoupling between the undercarriage and the superstructure is brought about.

26 Claims, 2 Drawing Sheets

VIBRATOR ROLLER FOR SOIL COMPACTION

BACKGROUND OF THE INVENTION

The invention relates to a vibrator roller for soil compaction. The vibration roller comprises an undercarriage having two roller drums disposed one after the other in a direction of travel and optionally embodied as a pair, and having front and rear imbalance generators associated with the roller drums in the form of rotating weights revolving out of phase by 180°, which subject the roller drums and the undercarriage to a vibrational motion. The vibrator roller also comprises a superstructure which includes at least a drive motor, control elements and the usual equipment, the superstructure being supported by the undercarriage via elastic resilient pads.

Numerous embodiments of vibrator rollers are known. When phase displacement of 180° between the front and rear imbalance generators is used, the purpose is to assure that one roller drum—the front and rear drum in alternation—will always be pressed against the earth during the revolution of the imbalance generators. As a result, the vibrator roller is easy to steer and can also drive up slopes, or in other words is a good climber.

OBJECT AND SUMMARY OF THE INVENTION

An object of the present invention is to largely reduce the transmission of vibration to the superstructure, with the resultant damage to the built-in parts, while maintaining aforementioned favorable properties. These objects are intended to be achieved particularly in rollers having cantilevered roller drums, because elastic mounting is not possible in that case.

This object is attained in accordance with the invention in that at least one resilient pad is positioned in the vicinity of the minimum vibration of the undercarriage, and that this resilient pad or pads support the main weight of the superstructure.

The invention is based on the recognition that in vibrator rollers having two imbalance generators with 180° phase displacement, a zone exists where the vibration amplitude tends to become nearly zero. Depending on the vibration amplitudes of the front and rear roller drums, this zone is located in the middle between the two roller drums or is shifted more toward one or the other roller drum. In terms of the height of this zone, experiments by the present applicant have unexpectedly shown that it is not at the level of the roller drum axes but rather somewhat above the axes.

Ideal vibrational decoupling is achieved between the undercarriage and the superstructure because provision is made in terms of the engineering of the superstructure and undercarriage so that both the aforementioned parts extend into this zone of minimum vibration and are there joined to one another by resilient pads.

In terms of the embodiment of the resilient pads, it is recommended that rubber pads with an axis extending transversely to the travel direction be used. Thus, the residual vibrations that can arise even in the zone of minimum vibration when there is uneven ground and other irregularities can easily be compensated for.

Because of the central suspension of the superstructure according to the invention and because the center of gravity of the superstructure is located at a higher point relative to the superstructure, pitching or rocking motions of the superstructure, or in other words pivoting motions about its central suspension, can occur during operation. To eliminate these vibrations, it is recommended in a further feature of the invention that the superstructure be braced elastically on the undercarriage with respect to the aforementioned rocking motions, via at least one part cantilevered outward to the front or rear. The farther away this bracing is located from the aforementioned central suspension, the smaller are the forces that must be absorbed by the bracing.

For the bracing, resilient elements known per se can be used. However, it has been found to be particularly advantageous if the bracing is effected by means of at least one pivot lever that extends from its pivot point on the undercarriage approximately vertically to the curve of the motion of this pivot point that ensues during rocking motions, and for the pivot point on the superstructure and/or undercarriage to be embodied elastically, in particular as a torsion damper. Because of this alignment of the pivot lever, the vibrational motions of the pivot point on the undercarriage extend over approximately the same path that is defined when the lever pivots about its pivot point on the superstructure. As a result, vibrational motions of the undercarriage essentially produce only vibrational motions of the aforementioned pivot lever, yet its pivot point on the superstructure is not markedly displaced. This provides bracing against rocking motion that in turn transmits no vibrations to the superstructure.

Another suitable further feature of the invention, in the sense of resilient vibration, comprises locating the motor not in the superstructure, nor directly in the undercarriage, but rather on the undercarriage via separate resilient pads. From the standpoint of enabling construction at favorably cost, it is recommended that the resilient pads of the motor be disposed coaxially with those of the superstructure.

Known options are available for positioning the imbalance generators. However, in combination with the present invention it has proved to be particularly favorable for the imbalance generators to be disposed outside the roller drums, specifically approximately centrally above them.

The invention is also highly suitable for so-called trench rollers, in which the undercarriage has a bearing rib extending in the longitudinal center, on which the roller drums are supported on both sides.

In this case it is recommended that the bearing rib between the front and rear roller drums have a jib on each side, on which the resilient pads for the superstructure and optionally for the motor are mounted. The bracing against a rocking motion is effected in the upper region of the bearing rib, likewise via jibs on each side.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 2:
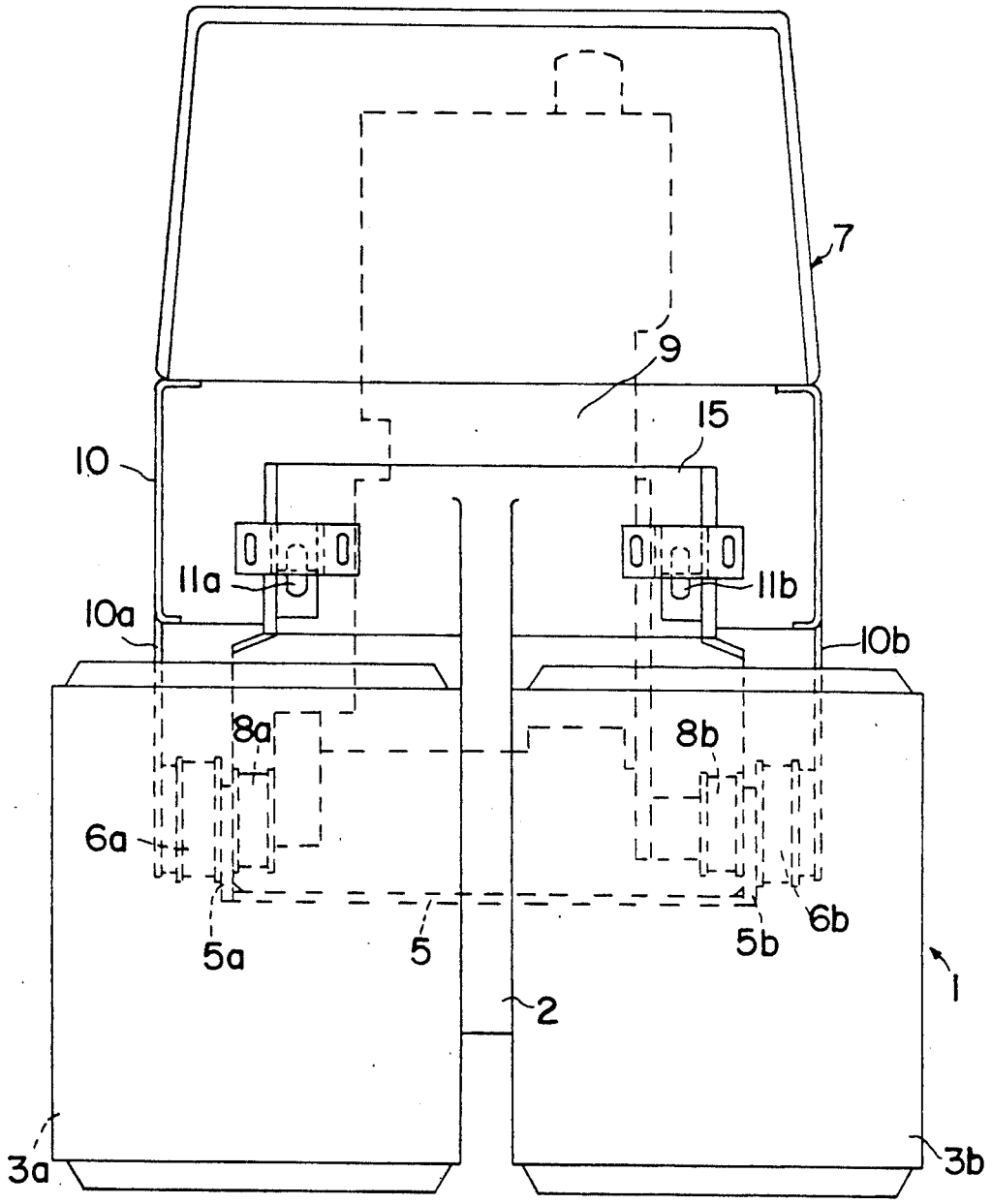
FIG. 2 shows the same vibrator roller in a front view.

The vibrator roller, embodied as a trench roller, comprises an undercarriage 1, which has a vertically extending bearing rib 2 extending in the longitudinal center in its lower region. Pairs of rollers 3 and 4 disposed one after the other in the travel direction are supported on either side of this bearing rib 2. As can be seen from FIG. 2, the front pair of rollers comprises a left roller 3*a* and a right roller 3*b*. The bearing and hydraulic drive of the roller drums are effected in a manner known per se, and will therefore not be described further here.

In the region between the front and rear rollers, the bearing rib 2 has a tub-like jib 5 protruding to both sides, the outer ends of which are embodied by vertical side walls 5*a* and 5*b*. These side walls are positioned such that they are located at least in the vicinity of the minimum vibration of the undercarriage 1. This zone extends between the roller drums 3 and 4 transversely to the travel direction, approximately at the height of the roller drum axes, preferably approximately 5 to 20 cm above the level of these axes. Naturally, this depends on the diameter of the roller drums and on their spacing.

Rubber-elastic elements 6*a* and 6*b* are provided for retaining the superstructure 7, and rubber-elastic elements 8*a* and 8*b* are disposed on both sides of these side walls 5*a* and 5*b* for retaining the motor 9. These rubber-elastic elements are capable of good isolation of the remaining multi-axial vibrations.

Figure 1:
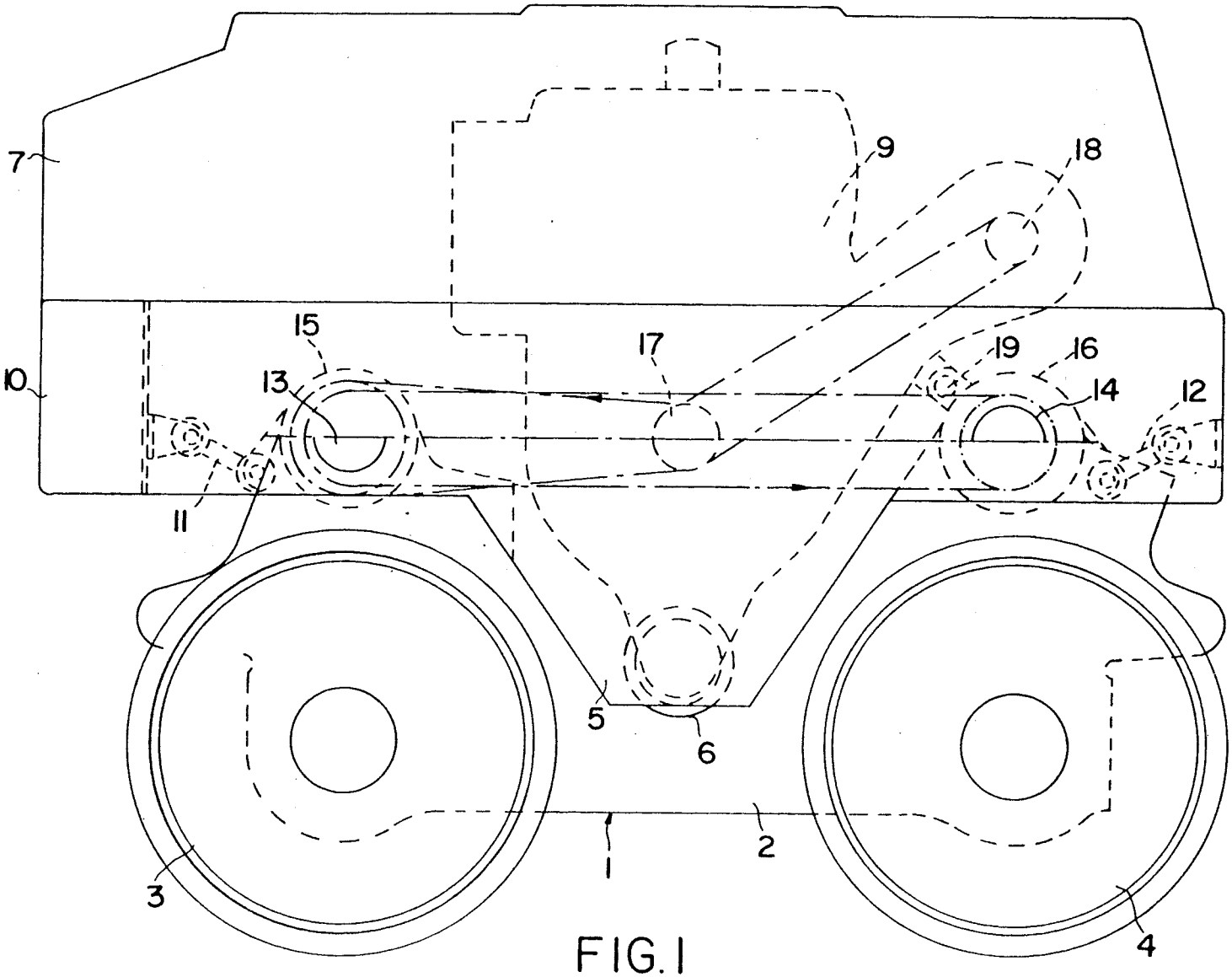
FIG. 1 shows a vibrator roller in a side view.

As can be seen particularly in FIG. 1, the superstructure 7 with its side walls 10*a* and 10*b* is extended downward between the roller drums far enough that it can be secured to the resilient elements 6*a* and 6*b*. In this way, the weight of the superstructure 7 is supported entirely or at least predominantly in the region of the undercarriage where the undercarriage has its minimum vibration.

To avoid a rocking motion, the superstructure 7 is additionally elastically supported on its front and rear ends via its frame 10 on the undercarriage. This is done via pivot levers 11 and 12, which are pivotably attached on the one hand to the frame 10 and on the other to opposed points on the undercarriage 1. The pivot levers extend approximately in the travel direction but are aligned approximately on the axis of the elastic elements 6*a* and 6*b*, so that they can optimally balance out rocking motions of the undercarriage about this axis. Instead of pivotable levers 11, 12 preferably simple damping cushions can be used, especially in form of rubber blocks. They give the same support function, but are much cheaper.

For vibrational decoupling, the pivot levers 11 and 12 are each provided on their ends with rubber cushions or the like, so that there is no direct metal-to-metal contact between the undercarriage and the superstructure.

Finally, FIG. 1 also shows the imbalance generators 13 and 14 with their weights offset by 180°. The imbalance generators are each accommodated in a front and rear tube 15, 16, respectively, on the upper end of the bearing rib 2, rather precisely above the axis of rotation of the front and rear roller drums, respectively. Their drive is effected in a manner known per se by means of a pulley 17 driven by the motor 9, not shown in detail, and suitable V-belts. In the conventional manner, this motor also drives a dual pump 18, which in turn acts with pressure oil on the hydraulic motors (not shown in detail) in the roller drums and thus provides for the travel motion of the vibrator roller.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A vibratory roller for soil compaction which comprises an undercarriage (1) having a pair of front roller drums 3*a*, 3*b*) and a pair of rear roller drums (4) secured thereto and disposed one after the other in a direction of travel, front and rear imbalance generators (13, 14) connected with said roller drums and said undercarriage for acting on said roller drums, said front and rear imbalance generators being in the form of rotating weights that revolve with a phase difference of 180°, which subject the roller drums and the undercarriage to a vibrational motion, a superstructure (7) supported on said undercarriage and which includes a drive motor, control elements and operative equipment, said superstructure (7) is supported by the undercarriage (1) via elastic resilient pads, whereby at least one supporting resilient pad (6*a*, 6*b*) positioned between said front and rear rollers is in a position of a minimum vibration of the undercarriage (1) which is between the front and rear rollers, and said at least one resilient pad supports a main weight of the superstructure (7).

2. A vibratory roller as defined by claim 1, in which a central portion of said superstructure (7) extends downward into a position of the minimum vibration between the front and rear roller drums (3 and 4) respectively.

3. A vibratory roller as defined by claim 1, in which said at least one resilient pad (6*a*, 6*b*) disposed at the point of minimum vibration of said undercarriage is embodied as a rubber pad with an axis extending transversely to a travel direction.

4. A vibratory roller as defined by claim 2, in which said at least one resilient pad (6*a*, 6*b*) disposed at the point of minimum vibration of said undercarriage is embodied as a rubber pad with an axis extending transversely to a travel direction.

5. A vibratory roller as defined by claim 1, in which said superstructure (7) is braced elastically on said undercarriage (1) against a rocking motion, particularly in the travel direction, via means positioned between a frame (10) and a partition of said superstructure extending to the front or the rear.

6. A vibratory roller as defined by claim 5, in which said superstructure braced against rocking motion is effected by means of at least one pivot lever (11, 12), which extends from a pivot point on the superstructure (7) to a point on the undercarriage approximately in a direction of an imaginary line to the point of minimum vibration of the undercarriage (1), and that the pivot point on the undercarriage and/or on the superstructure is embodied as elastic and in particular as a torsion damper.

7. A vibratory roller as defined by claim 5, in which said bracing against a rocking motion of the superstructure (7) is effected at front and/or rear points of said frame and said superstructure offset on both sides with respect to an imaginary vertical central longitudinal plane.

8. A vibratory roller s defined by claim 6, in which said bracing against a rocking motion of the superstructure (7) is effected at front and/or rear points of said frame and said superstructure offset on both sides with respect to an imaginary vertical central longitudinal plane.

9. A vibratory roller as defined by claim 1, in which said motor (9) is supported on the undercarriage (1) via at least one separate resilient pad (8*a*, 8*b*).

10. A vibratory roller as defined by claim 2, in which said motor (9) is supported on the undercarriage (1) via at least one separate resilient pad (8a, 8b).

11. A vibratory roller as defined by claim 3, in which said motor (9) is supported on the undercarriage (1) via at least one separate resilient pad (8a, 8b).

12. A vibratory roller as defined by claim 9, in which said at least one resilient pad (8a, 8b) of the motor (9) is disposed coaxially to said at least one resilient pad (6a, 6b) of the superstructure (7), at the point of minimum vibration.

13. A vibratory roller as defined by claim 10, in which said at least one resilient pad (8a, 8b) of the motor (9) is disposed coaxially to said at least one resilient pad (6a, 6b) of the superstructure (7), at the point of minimum vibration.

14. A vibratory roller as defined by claim 11, in which said at least one resilient pad (8a, 8b) of the motor (9) is disposed coaxially to said at least one resilient pad (6a, 6b) of the superstructure (7), at the point of minimum vibration.

15. A vibratory roller as defined by claim 1, in which said imbalance generators (13, 14) are disposed above the roller drums (3, 4).

16. A vibratory roller as defined by claim 2, in which said imbalance generators (13, 14) are disposed above the roller drums (3, 4).

17. A vibratory roller as defined by claim 3, in which said imbalance generators (13, 14) are disposed above the roller drums (3, 4).

18. A vibratory roller as defined by claim 1, in which said undercarriage includes a bearing rib (2) extending in a longitudinal center for the roller drums (3, 4) and the bearing rib (2) has one jib (5) on each side between the front and rear roller drums (3, 4) on which the resilient pads (6a, 6b, 8a, 8b) for the superstructure (7) and the motor (9) are mounted.

19. A vibratory roller as defined by claim 2, in which said undercarriage includes a bearing rib (2) extending in a longitudinal center for the roller drums (3, 4) and the bearing rib (2) has one jib (5) on each side between the front and rear roller drums (3, 4) on which the resilient pads (6a, 6b, 8a, 8b) for the superstructure (7) and the motor (9) ar mounted.

20. A vibratory roller as defined by claim 3, in which said undercarriage includes a bearing rib (2) extending in a longitudinal center for the roller drums (3, 4) and the bearing rib (2) has one jib (5) on each side between the front and rear roller drums (3, 4) on which the resilient pads (6a, 6b, 8a, 8b) for the superstructure (7) and the motor (9) are mounted.

21. A vibratory roller as defined by claim 9, in which said motor (9) is braced against a rocking motion by means of at least one additional resilient pad (19) on the undercarriage (1).

22. A vibratory roller as defined by claim 10, in which said motor (9) is braced against a rocking motion by means of at least one additional resilient pad (19) on the undercarriage (1).

23. A vibratory roller as defined by claim 11, in which said motor (9) is braced against a rocking motion by means of at least one additional resilient pad (19) on the undercarriage (1).

24. A vibratory roller as defined by claim 5. which includes resilient elements (11, 12) that brace against a rocking motion.

25. A vibratory roller as defined by claim 24, in which a spacing of the resilient elements (11, 12) is at least approximately equal to a spacing between the roller drums (3, 4).

26. A vibratory roller for soil compaction as set forth in claim 1 which includes damping cushions that connect the superstructure with the undercarriage.

* * * * *